US011295587B2

(12) United States Patent
Mazur et al.

(10) Patent No.: US 11,295,587 B2
(45) Date of Patent: Apr. 5, 2022

(54) METHOD AND APPARATUS FOR DEFINING A DETECTION ZONE

(71) Applicant: UTC Fire & Security EMEA BVBA, Diegem (BE)

(72) Inventors: Mateusz Mazur, Sopot (PL); Maciej Sobczyk, Gdansk (PL)

(73) Assignee: UTC FIRE & SECURITY EMEA BVBA, Diegem (BE)

( * ) Notice: Subject to any disclaimer, the term of this patent is extended or adjusted under 35 U.S.C. 154(b) by 0 days.

(21) Appl. No.: 16/999,663

(22) Filed: Aug. 21, 2020

(65) Prior Publication Data

US 2021/0056822 A1 Feb. 25, 2021

(30) Foreign Application Priority Data

Aug. 23, 2019 (EP) ..... 19193489

(51) Int. Cl.
*G08B 13/181* (2006.01)

(52) U.S. Cl.
CPC ..... *G08B 13/181* (2013.01)

(58) Field of Classification Search
CPC ..... G08B 13/181; G08B 29/20; G08B 13/19613; G06T 2207/30241; G06T 7/215; H04N 7/188
See application file for complete search history.

(56) References Cited

U.S. PATENT DOCUMENTS 6,573,857 B2 6/2003 Fullerton et al.
6,927,725 B2 8/2005 Wittenberg et al.
2002/0109624 A1 8/2002 Schutz et al.
2004/0027270 A1* 2/2004 Fullerton ..... G01S 13/888 342/28
2011/0050878 A1* 3/2011 Wells ..... H04N 7/181 348/86
2014/0028842 A1* 1/2014 Abramson ..... G06K 9/00785 348/143
2015/0249807 A1* 9/2015 Naylor ..... G08B 13/19613 348/155
2016/0266577 A1* 9/2016 Kerzner ..... G08B 13/19697
2017/0123058 A1 5/2017 Yavari et al.

FOREIGN PATENT DOCUMENTS

EP 3525002 A1 8/2019

OTHER PUBLICATIONS

European Search Report for application EP 19193489.2, dated Dec. 10, 2019, 8 pages.

* cited by examiner

*Primary Examiner* — Mirza F Alam
(74) *Attorney, Agent, or Firm* — Cantor Colburn LLP

(57) ABSTRACT

A method of calibrating a sensor (200) for a security system, the method comprising: switching the sensor (200) to a zone calibration mode for configuring the sensor (200) to operate with a detection zone; detecting a moveable object (202) moving along a border of the detection zone, wherein the sensor (200) detects the position of the moveable object (202) as the moveable object (202) moves along the border of the detection zone; calculating zone calibration data for the detection zone based on the detected positions of the moveable object (202); and configuring the sensor (200) to operate using the calculated zone calibration data.

15 Claims, 4 Drawing Sheets

METHOD AND APPARATUS FOR DEFINING A DETECTION ZONE

FOREIGN PRIORITY

This application claims priority to European Patent Application No. 19193489.2, filed Aug. 23, 2019, and all the benefits accruing therefrom under 35 U.S.C. § 119, the contents of which in its entirety are herein incorporated by reference.

BACKGROUND

The present disclosure relates to a method and an apparatus for defining a detection zone for a security system.

Current security systems may use a number of different sensor types to detect movement or potential intruders. For example, infrared (IR) sensors can detect an object or person having a temperature that is significantly different to the background temperature. Video detection may also be used. Other sensors may use radar waves or laser-based systems for intruder detection.

It is an advantage for a security system to operate with a detection zone associated with each sensor. The detection zone is a region monitored by the sensor and the sensor may trigger an alarm if the sensor detects an intruder or some other change, such as movement or temperature, compared to a background within the detection zone. The sensor may be able to detect intruders or other changes outside the detection zone, but will not trigger an alarm while the intruder remains outside the detection zone. For the sensor to have such a feature, it should have position estimation functionality. The detection zone may be established by drawing out the zone on a computer using an overlay of a room or space in which the security system is to be set up. A user then can check the calibration of the detection zone.

The use of a detection zone of this type can be of particular importance where the sensor has a range that is greater than the required area to be monitored and/or where the sensors can detect intruders or other changes beyond the detection zone, including beyond the walls of an area that is monitored by the sensor. In the case of radar type sensors, for example, it is possible for the sensor to detect intruders even if there are intervening walls or objects, such as furniture.

Where rooms are consistent sizes, such as in hotels, predefined detection zones can be used. These predefined zones may be of a particular shape so that, when the sensor is installed correctly into a room, with accurate alignment, then there is no need to set up a detection zone separately. The problem here is that if the sensor is misaligned on installation or at a later time, the predefined zone would be misaligned with the room or space the sensor is placed in. A user would then have to readjust the sensor and check that the detection zone is correct, which may take more than one attempt.

Additionally, proper orientation of the sensor to a predefined zone requires further steps and apparatus to define the sensor orientation (e.g. using a compass) and location placement (e.g., reference distance to indoor construction elements, GPS or any other appropriate location detection methods). This requires additional time and expense to validate sensor performance and may still be carried out incorrectly due to human error during calibration of the sensor.

Angular misalignment of sensors using predefined zones, no matter how small the misalignment is, can lead to false or missed alarms.

SUMMARY

Viewed from a first aspect the invention provides a method of calibrating a sensor for a security system, the method comprising: switching the sensor to a zone calibration mode for configuring the sensor to operate with a detection zone; detecting a moveable object moving along a border of the detection zone, wherein the sensor detects the position of the moveable object as the moveable object moves along the border of the detection zone; calculating calibration data for the detection zone based on the detected positions of the moveable object; and configuring the sensor to operate using the calculated calibration data.

Viewed from a second aspect the invention provides a security system comprising a sensor, the sensor having a zone calibration mode for configuring the sensor to operate with a detection zone and the sensor being configured to: switch to the zone calibration mode; detect a moveable object moving along a border of a detection zone, wherein the sensor is configured to detect the position of the moveable object as the moveable object moves along the border of the detection zone; calculate zone calibration data for the detection zone based on the detected positions of the moveable object; and configure itself for operation using the calculated zone calibration data.

Viewed from a third aspect the invention provides a computer programme product containing instructions that, when executed within a security system comprising a sensor, will configure the sensor to operate in accordance with the method of the first aspect. The computer programme product may for example be software or firmware, which may be executed and/or stored on any suitable device (e.g. built/implemented in sensor).

The features discussed below may apply to any or all of the first aspect, the second aspect or the third aspect.

Once the zone calibration of the sensor is completed the sensor may switch out of the zone calibration mode. For example it may switch to a monitoring mode or a standby mode.

The zone calibration of the sensor may be carried out by a person upon installation of the security system. The zone calibration may be carried out by switching the sensor into a zone calibration mode and the person may then walk along a path to designate the desired border of the detection zone. Thus, the person, i.e. a user, may be the moveable object. The sensor, in zone calibration mode, may detect the motion of the person as they walk along the path and record the position of the person continuously or in specified increments of time, such as an increment of time selected from time intervals ranging from a nanosecond to a millisecond to a second, for example the position may be recorded every millisecond, every second, or some other time period to be specified The path traced out by the person and detected by the sensor may then be stored as position data. The position data may be recorded and stored in a memory unit of the sensor or sent to a managing unit. Once the person has completed the walking along the desired border of the designation zone, the sensor or managing unit may then calculate zone calibration data for the detection zone of a sensor using the acquired position data. It will be noted that the moveable object, i.e. the person in this example, may not be able to move exactly aligned with the border, but instead may walk along it such as in the case of walking beside a wall. Thus, in this context the term "along" is intended to mean that the moveable object may trace a path with some known relationship to the (intended) border of the detection zone. The sensor and/or an associated calibration system may then be arranged to use the calculated zone calibration data, to configure the sensor to operate with a detection zone having borders based on the movement of the person.

An advantage of calibrating the sensor in this way is that there is no need to position the sensor in a particular angular alignment or a person installing the sensor does not need to spend time drawing out a detection using a computer. This method allows the security system to be easily calibrated to the shape of any room or space in which a detection zone is desired without the need for additional tools or equipment.

The moveable object detectable by the sensor when it is in the zone calibration mode may be a person as mentioned above. Alternatively it may be a drone or other unmanned vehicle, where the drone may be piloted by a person or may be autonomous.

The detection zone may be visualised as a two-dimensional shape at a set height above the ground. The sensor may be configured to operate to detect intruders within a volume that extends a set distance above and/or below the two-dimensional shape.

The detection zone may be a three-dimensional space, where the boundary of the volume may be mapped out by a drone or other moveable object.

The zone calibration of the sensor may be carried out at any time after installation, and zone calibration may be repeated during the use of the sensor. This may be due to the sensor being moved or if a user wishes to redefine the borders of a detection zone or even to create a new detection zone.

The security system may comprise multiple sensors to cover one or more detection zones. The multiple sensors may be calibrated simultaneously or separately. The multiple sensors may be configured to form a mesh network. In a mesh network, the sensors may be configured to cover different parts of a defined detection zone.

The zone calibration mode of the sensor may involve additional processing of the zone calibration data for the detection zone. Such post-processing may involve processing the zone calibration data to smooth out any kinks in the detection zone border traced by the moveable object.

The zone calibration data may be additionally modified to expand the zone detection border. The zone detection border may be expanded by any amount and may be limited to 20 cm, 50 cm, 1 m or any other value suitable to the environment the zone detection border is being set up in. For example, the zone detection border may only be needed to be expanded by a small amount in a hotel room, but the detection border may need to be extended by a much larger amount in an outdoor space such as a garden. An advantage of this is that, since the user or moveable object may not be able to move along the desired borders of a detection zone due to obstructions such as walls, fences or furniture, the border traced by the user or moveable object may be expanded to cover the desired detection zone.

The zone calibration data may be additionally post-processed to adjust the zone calibration data to conform to a predefined zone, wherein the predefined zone is a polygon such as rectangular or circular or any other two-dimensional polygon. This may have an advantage that, if there are obstructions, such as furniture, along the path of the desired border, the moveable object may move around the obstructions and the zone calibration data recorded by the sensor may be processed to conform to a shape so that the border of the detection zone may pass through or around the obstructions.

The sensor may be installed indoors, such as in a room of a living space or in a warehouse, or in an outdoor space, such as a garden or driveway.

The zone calibration mode may comprise defining multiple detection zones. This may involve the user or moveable object moving along one or more additional detection zone borders to define additional detection zones. An advantage of this is that multiple detection zones may be defined for a single security system, allowing the coverage of multiple rooms in a house or apartment, for example.

To apply the zone definition feature the sensor must have ability to estimate the position of an object. For example, the sensor may detect the angular position relative to a reference direction, along with the distance of the object from the sensor. Generally it may be applied to radars, LIDARs (laser radars) or sonic sensors with mechanical or electrical beam scanning giving angular resolution and with applied method to get distance to object like e.g. time delay of received pulses or FMCW (frequency modulated continuous wave). These types of sensors can be used to give advantages in place of cheaper IR sensors, including greater accuracy in terms of locating the position of an object rather than simply the presence of an object.

Radar sensors may have some advantages over IR sensors such as increased resolution of detected images and an ability to detect the position of an intruder relative to the sensor within the detection zone of the sensor. Another advantage of a radar sensor is that radio waves are able to penetrate through a wide range of materials. This means that furniture in a room or even walls would not prevent a radar sensor from detecting intruders in a detection zone that is on the other side of a wall or is in some other way obstructed in terms of visible line-of-sight. Therefore, a detection zone may be established behind a wall or other obstruction relative to the sensor Typical IR sensors, on the other hand, react to significant changes in background heat radiation in the field of view of the sensor. An IR sensor would typically not be able to detect an intruder behind a wall or other obstacle.

LIDAR sensors have an advantage over radar sensors in that they have high resolution, and so are able to detect the position of an individual with greater precision. A drawback, however, is that LIDAR sensors are unable to penetrate opaque surfaces and objects, such as walls, and so cannot detect individuals behind opaque objects.

The sensor may comprise a processor, a memory unit, a transmitter, and a receiver. The transmitter may be configured to transmit radio signals in to a space that includes the detection zone for sensing moving objects and persons. The transmitter may also be configured to transmit signals to a control device, the control device configured to control the sensor. The transmitter may also be configured to transmit signals to other sensors. The transmitter may be any kind of antenna with generator producing appropriative signal. The sensor may comprise multiple transmitters for separate transmission of communications between devices and for positional sensing. The radio signals may be transmitted at a frequency of 900 MHz, 2.4 GHz, 5.8 GHz, 10 GHz, 24 GHz, 60 GHz bands, or any other frequency according to standards-based frequency ranges.

For a LIDAR sensor, a laser device may be used in place of the radio transmitter for beaming light into the detection zone. A transmitter may still be used for communication with other sensors or control devices.

The signals may be reflected by objects in the space. Reflected radio wave may be detected by the receiver. The receiver may share an antenna with the transmitter or may be a separate antenna. The receiver may comprise multiple antennas oriented in different directions to collect the reflected signals. The receiver may also be configured to collect signals from a control device or from other sensors.

For a LIDAR sensor, usually light detector detection device for detecting light reflected by objects or persons moving in the detection zone. A receiver may still be used for receiving signals from other sensors or a control device.

The processor may then be configured to determine the distance from the sensor to objects in the space and/or the detection zone. The processor may also be configured to process positional data and to calculate the detection zone.

The memory may be configured to store positional data and the configuration of the detection zone. The sensor may be configured to receive power from a wall power supply or an internal battery.

DRAWING DESCRIPTION

Certain embodiments of the disclosure will now be described by way of example only and with reference to the accompanying drawings in which.

DETAILED DESCRIPTION

Figure 1B:
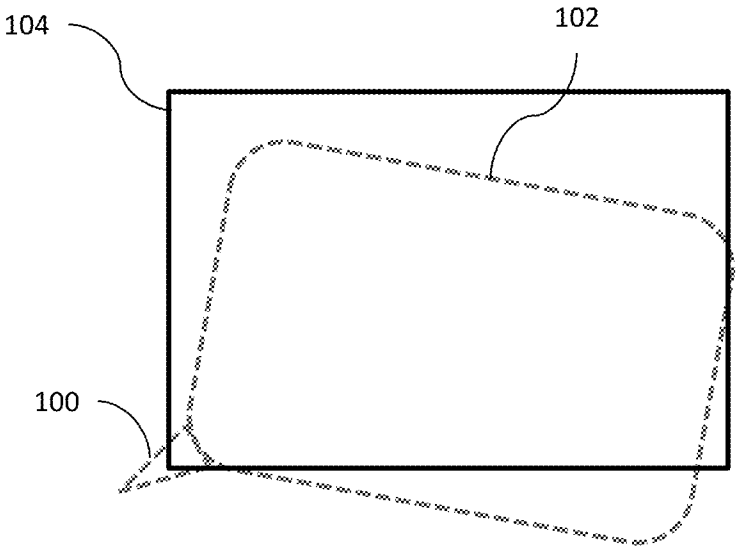
FIGS. 1A and 1B illustrate a sensor of a security system of the prior art having a predefined detection zone for a room.
Figure 1A:
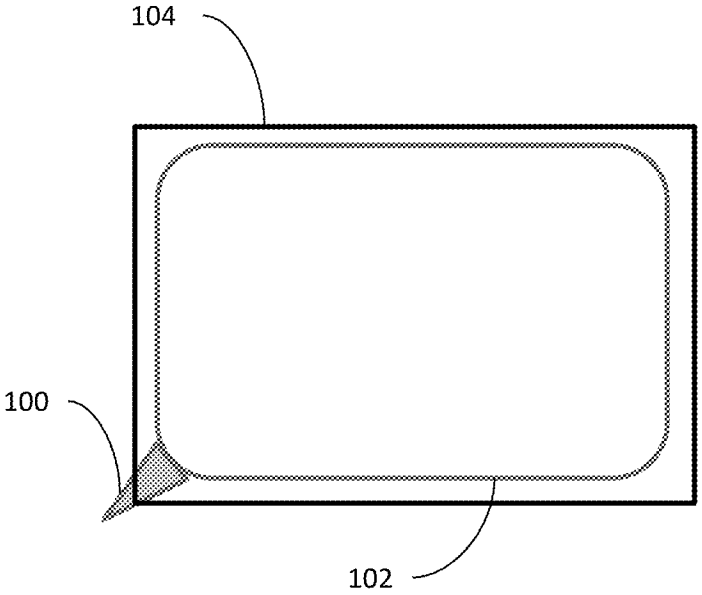

FIGS. 1A and 1B illustrate a sensor 100 of a security system of the prior art having a predefined detection zone 102 for a room 104. When positioned correctly, the predefined zone 102 covers the whole of the room and the sensor 100 is capable of detecting intruders in the room 104, as shown in FIG. 1A. If, however, the sensor 100 is not positioned correctly or is moved after installation, the orientation of the predefined zone 102 will also be repositioned such that the detection zone 102 no longer covers the room 104 in which the sensor 100 is positioned, as shown in FIG. 1B.

Figure 2:
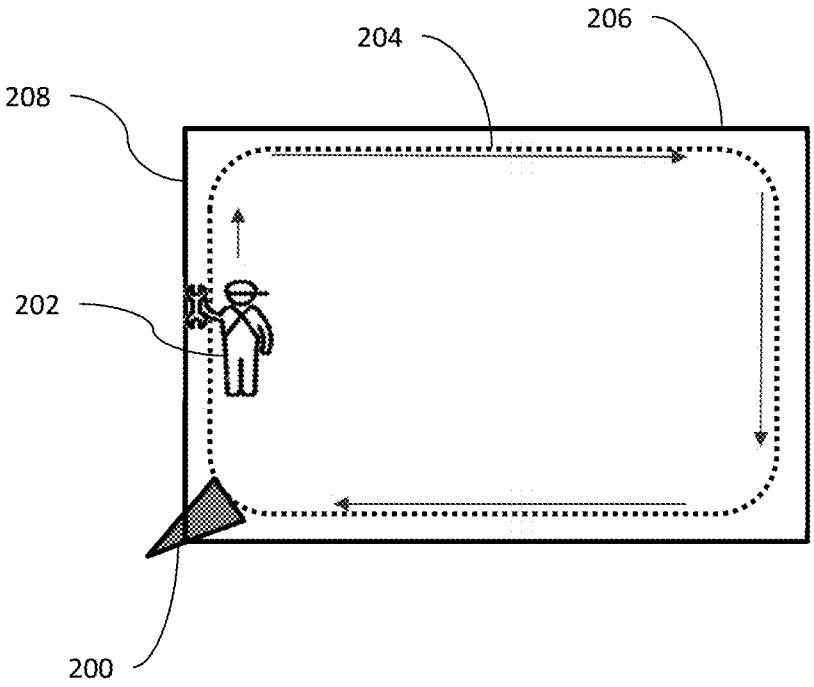
FIG. 2 illustrates a method of calibrating a sensor.
Figure 3:
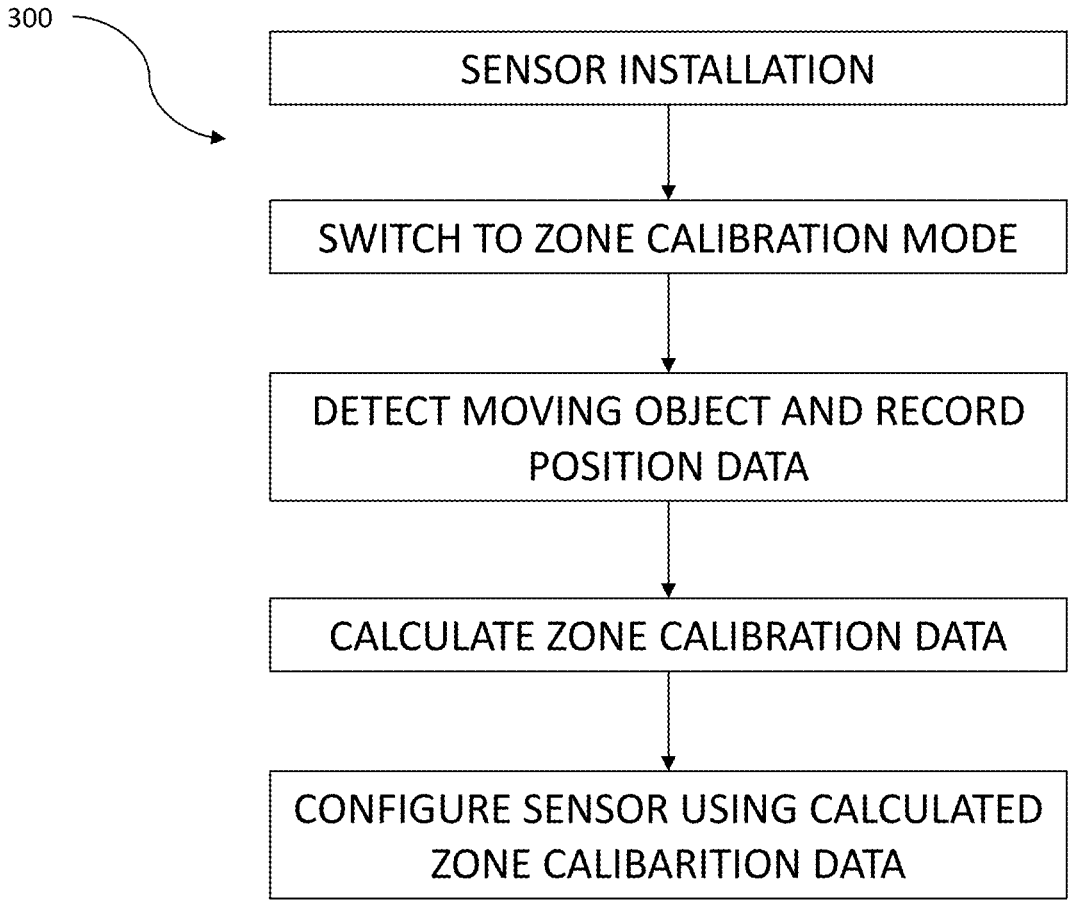
FIG. 3 shows a flowchart of the method steps.

FIG. 2 illustrates a method of calibrating a sensor 200 and FIG. 3 shows a flowchart 300 of the method steps. The sensor 200 is installed in a location in which a detection zone is to be set up. During installation or at any other time after installation, the sensor 200 can be switched to a zone calibration mode. The zone calibration mode allows a user 202 to calibrate a detection zone for the sensor 200 using the method described below.

Zone calibration mode configures the sensor 200 to collect positional data from a moving object or person. A user 202 performing zone calibration of the sensor will switch the sensor 200 to zone calibration mode and the user 202 then walks along a path 204 to designate the desired border of the detection zone. The path 204 shown in FIG. 2 is along the edges of a room 206. The sensor 200, in zone calibration mode, detects the motion of the user 202 as they walk along the path 204 and records the position of the user 202 continuously or in specified increments of time, such as every millisecond, second, or some other time period to be specified.

The path traced out by the user 202 and detected by the sensor 200 is then stored as position data. Once the user 202 has completed the walking along the desired border of the designation zone, the sensor 200 is configured to calculate zone calibration data for the detection zone using the acquired position data. It will be noted that the user 202 may not be able to move exactly aligned with an intended border, but instead may walk along it such as in the case of walking beside a wall 208. Thus, in this context the term "along" is intended to mean that the user 202 may trace a path with some known relationship to the (intended) border of the detection zone. The sensor 200 is then arranged to use the calculated zone calibration data, to configure the sensor 200 to operate with a detection zone having borders based on the movement of the user 202.

Figure 4:
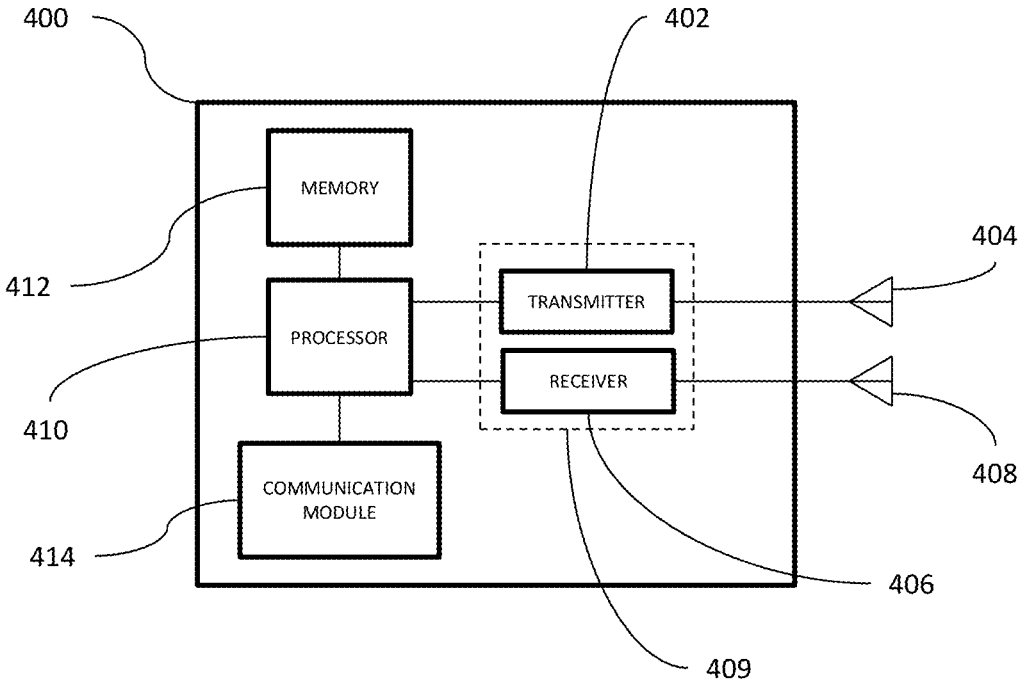
FIG. 4 illustrates a schematic view of a sensor.

FIG. 4 depicts a schematic view of a components in a sensor 400 configured to use the method outlined above. The sensor 400 includes one or more hardware components to enable the sensor 400 to detect one or more persons or other objects in the detection zone.

The sensor 400 includes a transmitter 402 connected to a transmitter antenna system 404. The transmitter 402 generates signals that are transmitted via the transmitter antenna 404 for sensing moving objects. The sensor 400 also includes a receiver 404 for the detection of radio signals initially transmitted by the transmitter 402 and reflected back. The receiver 404 is also configured to receive signals via the receiver antenna 408 from control devices and other sensors. The receiver 406 is connected to a receiver antenna system 408.

The transmitter 402 and the receiver 406 may be integrated in one chip (IC) 409.

The sensor 400 further includes a processor or processors 410 configured to control the transmitter 402, the receiver 406 and to process positional data and to calculate the detection zone. The sensor 400 also includes a memory unit 412 configured to store positional data and the configuration of the detection zone. Optionally, the sensor 400 may be equipped with a communication module 414 configured to communicate and network with other sensors.

What is claimed is:

1. A method of calibrating a sensor for a security system, the method comprising:

switching the sensor to a zone calibration mode for configuring the sensor to operate with a detection zone;

detecting a moveable object moving along a border of the detection zone, wherein the sensor detects the position of the moveable object as the moveable object moves along the border of the detection zone, wherein the moveable object is a remote controlled drone;

calculating zone calibration data for the detection zone based on the detected positions of the moveable object; and configuring the sensor to operate using the calculated zone calibration data;

wherein the border of the detection zone is additionally post-processed;

wherein the post-processing comprises adjusting the border of the detection zone to conform to a predefined zone, wherein the predefined zone is a polygon such as rectangular or circular or any other two dimensional polygon.

2. The method of claim 1, wherein the post-processing comprises smoothing the border of the detection zone.

3. The method of claim 1, wherein the post-processing comprises expanding the border of the detection zone, wherein the border of the detection zone is expanded by about 20 cm.

4. The method of claim 1, wherein the sensor is installed in a room or an outdoor garden.

5. The method of claim 1, wherein the data collection steps are carried out multiple times to define more than one detection zone.

6. The method of claim 1, wherein the sensor is a radar sensor or a LIDAR sensor or an acoustic sensor.

7. The method of claim 1, wherein the security system comprises multiple sensors.

8. The method of claim 1, wherein the moveable object is a person.

9. A security system comprising a sensor, the sensor having a zone calibration mode for configuring the sensor to operate with a detection zone and the sensor being configured to:

switch to the zone calibration mode;

detect a moveable object moving along a border of a detection zone, wherein the sensor is configured to detect the position of the moveable object as the moveable object moves along the border of the detection zone, wherein the moveable object is a remote controlled drone;

calculate zone calibration data for the detection zone based on the detected positions of the moveable object; and configure itself for operation using the calculated zone calibration data;

wherein the border of the detection zone is additionally post-processed;

wherein the post-processing comprises adjusting the border of the detection zone to conform to a predefined zone, wherein the predefined zone is a polygon such as rectangular or circular or any other two dimensional polygon.

10. A security system comprising a sensor configured to operate in accordance with the method of claim 1.

11. A computer program product containing instructions that, when executed within a security system comprising a sensor, will configure the sensor to operate in accordance with the method of claim 1.

12. A method of calibrating a sensor for a security system, the method comprising:

switching the sensor to a zone calibration mode for configuring the sensor to operate with a detection zone;

detecting a moveable object moving along a border of the detection zone, wherein the sensor detects the position of the moveable object as the moveable object moves along the border of the detection zone;

calculating zone calibration data for the detection zone based on the detected positions of the moveable object; and configuring the sensor to operate using the calculated zone calibration data, wherein the border of the detection zone is additionally post-processed, wherein the post-processing comprises adjusting the border of the detection zone to conform to a predefined zone, wherein the predefined zone is a polygon such as rectangular or circular or any other two dimensional polygon.

13. A security system comprising a sensor, the sensor having a zone calibration mode for configuring the sensor to operate with a detection zone and the sensor being configured to:

switch to the zone calibration mode;

detect a moveable object moving along a border of a detection zone, wherein the sensor is configured to detect the position of the moveable object as the moveable object moves along the border of the detection zone;

calculate zone calibration data for the detection zone based on the detected positions of the moveable object; and configure itself for operation using the calculated zone calibration data, wherein the border of the detection zone is additionally post-processed, wherein the post-processing comprises adjusting the border of the detection zone to conform to a predefined zone, wherein the predefined zone is a polygon such as rectangular or circular or any other two dimensional polygon.

14. A method of calibrating a sensor for a security system, the method comprising:

switching the sensor to a zone calibration mode for configuring the sensor to operate with a detection zone;

detecting a moveable object moving along a border of the detection zone, wherein the sensor detects the position of the moveable object as the moveable object moves along the border of the detection zone;

calculating zone calibration data for the detection zone based on the detected positions of the moveable object; and configuring the sensor to operate using the calculated zone calibration data, wherein the data collection steps are carried out multiple times to define additional detection zones;

wherein the border of the detection zone is additionally post-processed;

wherein the post-processing comprises adjusting the border of the detection zone to conform to a predefined zone, wherein the predefined zone is a polygon such as rectangular or circular or any other two dimensional polygon.

15. A security system comprising a sensor, the sensor having a zone calibration mode for configuring the sensor to operate with a detection zone and the sensor being configured to:

switch to the zone calibration mode;

detect a moveable object moving along a border of a detection zone, wherein the sensor is configured to detect the position of the moveable object as the moveable object moves along the border of the detection zone;

calculate zone calibration data for the detection zone based on the detected positions of the moveable object; and configure itself for operation using the calculated zone calibration data, wherein the data collection steps are carried out multiple times to define additional detection zones;

wherein the border of the detection zone is additionally post-processed;

wherein the post-processing comprises adjusting the border of the detection zone to conform to a predefined zone, wherein the predefined zone is a polygon such as rectangular or circular or any other two dimensional polygon.

* * * * *